United States Patent [19]

Brannen

[11] Patent Number: 5,058,627

[45] Date of Patent: Oct. 22, 1991

[54] FREEZE PROTECTION SYSTEM FOR WATER PIPES

[76] Inventor: Wiley W. Brannen, P.O. Box 253, Statesboro, Ga. 30458

[21] Appl. No.: 509,294

[22] Filed: Apr. 16, 1990

Related U.S. Application Data

[63] Continuation-in-part of Ser. No. 335,495, Apr. 10, 1989, abandoned.

[51] Int. Cl.[5] ..... E03B 7/12

[52] U.S. Cl. ..... 138/27; 138/26; 138/30; 138/32

[58] Field of Search ..... 138/28, 27, 26, 32, 138/30; 137/59, 207, 206, 208, 593

[56] References Cited

U.S. PATENT DOCUMENTS

| | | | |
|---|---|---|---|
| 596,062 | 12/1897 | Firey . | |
| 1,342,491 | 6/1920 | York | 138/26 |
| 1,648,467 | 11/1927 | Vautier | 138/27 |
| 1,672,393 | 6/1928 | Robison . | |
| 1,865,486 | 7/1932 | Seymour et al. | 137/207 |
| 2,124,551 | 7/1938 | Freidman et al. | 138/26 |
| 2,360,596 | 10/1944 | Tickel | 138/28 |
| 3,480,027 | 11/1969 | Noland . | |
| 4,154,264 | 5/1979 | Schaller | 137/207 |
| 4,321,908 | 3/1982 | Reed . | |
| 4,649,959 | 3/1987 | Wadleigh . | |

FOREIGN PATENT DOCUMENTS 2176565 12/1986 United Kingdom .

*Primary Examiner*—James E. Bryant, III
*Attorney, Agent, or Firm*—Laurence R. Brown

[57] ABSTRACT

A water pipe anti-rupture system for preventing freeze damage provides for an injection molded string of hollow cups spaced apart by a common connecting rod. Periodically spaced cross stabilizing leg members are disposed in a plane perpendicular to the connecting rod for frictionally engaging the inside of a water pipe to hold the cups in place substantially in the center and along a length of water pipe with hollows down so that they can entrap air. This system prevents bursting of the pipes when water freezes.

4 Claims, 1 Drawing Sheet

FREEZE PROTECTION SYSTEM FOR WATER PIPES

This is a continuation-in-part application of my copending application entitled Anti-rupture Device for Pipes, Ser. No. 07/335,495, filed Apr. 10, 1989, abandoned in favor of this application.

TECHNICAL FIELD

This invention relates to systems for protection of water pipes from bursting when water freezes in them, and more particularly it relates to such systems that introduce into the pipes a compressible material that absorbs the expansion of water when it freezes enough to prevent bursting of the pipe.

BACKGROUND ART

Various systems have been proposed to prevent the bursting of water pipes when water freezes and expands in them. Thus, externally connected branches or reservoirs have been used with compressible compartments outside the water pipes such as in Robison U.S. Pat. No. 1,672,393, June 5, 1928. These require extra piping and plumbing which may not fit in crowded spaces and which is very expensive. Specially constructed compressible air filled compartments within the water flow path such as provided in Noland U.S. Pat. No. 3,480,027, Nov. 25, 1969 or Wadleigh U.S. Pat. No. 4,649,959, Mar. 17, 1987 have the same objections and are subject to leakage and fatigue.

Various sealed or solid compressible bodies have been made for insertion within water pipes, such as in Tickel U.S. Pat. No. 2,360,596, Oct. 17, 1944, but these are subject to movement out of position with the flow of water through the pipe. Thus, Firey, U.S. Pat. No. 596,062, Dec. 28, 1897 has provided compressible rubber inserts of fixed length with flanges for holding them in place in the center of the pipe. These cannot be used around bends, such as found near outside faucets where protection is critical and where pipe dimensions vary because of faucets and couplings. Rubber deteriorates with age and cannot provide permanent protection.

Devices which move within the pipe such as in Reed U.S. Pat. No. 4,3211,908, Mar. 30, 1982 or multiple piece assemblies critical to assemble locate and install as found in the Craig-Hallam British publication 2,176,565A, Dec. 31, 1986 are complex and unsatisfactory because of critical installation, fixing in place and possiblity of failure in action.

It is therefore an object of this invention to provide an inexpensive and easy to install versatile system operable under various conditions that will stay in place and overcome the aforesaid deficiencies of the prior art.

DISCLOSURE OF THE INVENTION

An inexpensive, permanent and easy to install water pipe anti-rupture system is afforded by this invention to prevent freeze damage to water pipes, particularly outside water faucets. Thus a string of hollow cups aligned and fastened together with a connecting rod fastened from cup to cup so that the hollows are oriented in a single direction is preferably formed by injection molding a non-deteriorating plastic such as PVC. Periodically spaced resilient cross stabilizing leg members extend outwardly in opposite directions from the rod in a plane perpendicular to the rod of an overall length greater than the diameter of the pipe inside dimension, thereby to frictionally engage the pipe and hold a desired length of the spaced cup hollows downwardly to retain air therewithin and in place along the pipe in the critical area exposed to freezing such as from an outside faucet into the interior of a house. Thus, the pipe is protected from bursting when water freezes and expands therein by the compressible nature of the air maintained in the cup hollow by aerated water and retained air when the pipe is initially filled with water. A length of the spaced cup-connecting rod assembly is simply inserted in or vertically a horizontally or vertically disposed pipe and left in place for fail safe long life use.

Other objects, features and advantages of the invention are to be found throughout the following description, drawings and claims.

THE PREFERRED EMBODIMENTS

Figure 1:
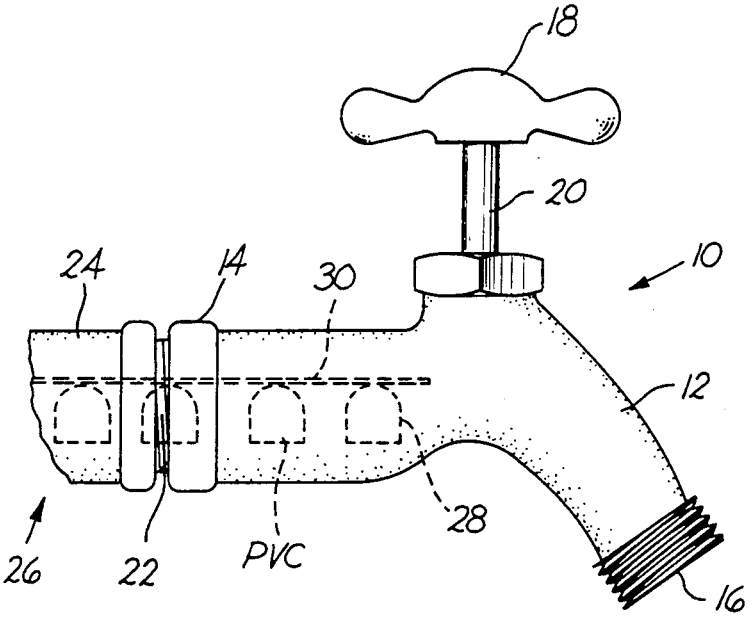
FIG. 1 is a fragmentary side view of an outdoor faucet showing one horizontally disposed embodiment of the anti-rupture system for preventing freeze damage in place inside the piping.
Figure 2:
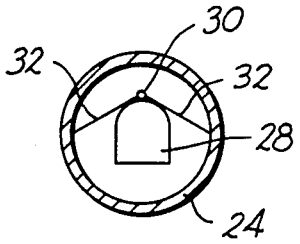
FIG. 2 is a left end view of the piping shown in FIG. 1.

Referring now to the drawings, and particularly to FIGS. 1 and 2 thereof, there is shown an outdoor faucet 10 having a faucet body 12 including a faucet inlet 14 and a faucet outlet 16 spaced from inlet 14. Outlet 16 can include an external thread for optional connection of an end of a hose, or the like. A handle 18 is connected to a shaft 20 that extends into the interior of the faucet body 12 to operate a suitable valve device (not shown) to control the volume of flow of water through the faucet.

A threaded connector sleeve 22 joins the faucet inlet 14 with a pipe 24 that is suitably connected with a source of water. Such faucets 10 which are outside a house, with the pipe 24 leading into the house, are subject to freezing with unpredicted cold snaps when the water is not turned off and thus may burst with the expanding ice pressure.

Thus the anti-rupture freeze protection system afforded by this invention is positioned within faucet body to extend through sleeve 22 and partially into pipe 24. Thus a sequence or string of spaced inverted cup chambers 28 are disposed on connecting rod 30 and held in place hollow downward to entrap air by means of the frictional engagement of the stabilizing leg members 32 projecting outwardly in opposite directions from the connecting rod 30. These stabilizing and positioning legs 32 are disposed in a plane perpendicular to the connecting rod 30 and are spaced periodically along the length of a section containing a plurality of the cups 28 to secure the anti-rupture system 26 in a permanent position within the pipe 24 with the cup hollows facing downwardly.

The cups 28 are bell shaped with a closed top portion and open bottom portion to provide a hollow chamber enclosed by continuous intermediate sidewall portions extending from top to bottom as shown in FIGS. 1 and 2. The chambers can be made of metal, molded plastic, or the like, with thin walls, light weight and thus of low cost. They are preferably of injection molded plastic such as polyvinyl chloride (PVC) which does not deteriorate in or pollute water, and thus the system 26 is a permanent installation.

Because of initial trapped air and probably dynamically introduced air derived from entrapped air in water flowing into or resident in the piping, the chamber provides a compressible medium of enough volume with the string of cups to absorb the expansion of freezing water and prevent bursting of the pipe 24 or faucet 12. This installation was tested with running water at 70 psi pressure after installation of the assembly 26 to temperatures up to twenty degrees below zero F without bursting pipe or spigot. Evaluation at Georgia Southern College Department of Physics has likewise shown that with thimbles of 230 milliliter volume, an air volume of 30 ml was left in the thimbles after passing water through at 40 psi when the cups 28 were retained with hollow downward.

Thus, the outwardly extending stabilizer legs 32 of stiff enough wire or plastic to frictionally engage the pipe walls such as shown in FIG. 2 will hold the hollows in place without rotation in the pipe 24. The rod 30 is stiff enough to push the cups 28 down into an open pipe and hold them separated. The orientation of the cups 28, rod 30 and stabilizing legs 32 is such that the cups 28 are essentially centered in the pipe. Thus, the anti-rupture system provides unitary, integral structure of low cost preparable by injection molding that is simply installed permanently in place for long term freeze protection. This is ideal for outside faucets of the type shown in FIG. 1 but can be used wherever pipes are exposed to the possibility of freezing.

Figure 3:
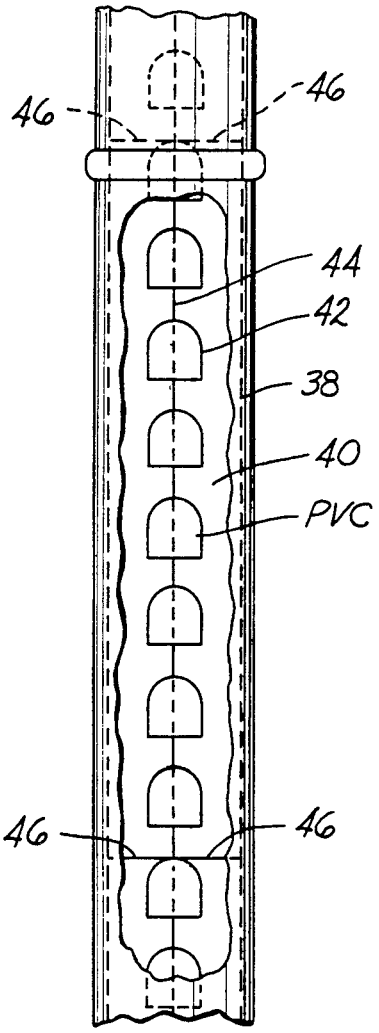
FIG. 3 is a side cut away view showing another vertically disposed embodiment of the invention positioned inside the pipe.
Figure 4:
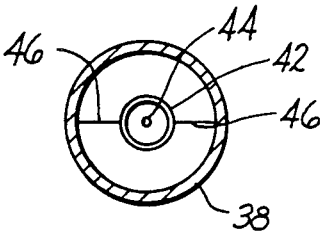
FIG. 4 is a bottom end view of the pipe of FIG. 3.

As shown in FIGS. 3 and 4, another embodiment positions the cups 42 vertically in pipe 38 on connecting rod 44 extending axially through the string of cups to provide the anti-rupture system 40. The stabilizing legs 46 hold the system in place for permanent use. In this embodiment the cups with their hollow chambers are placed vertically one above another in vertically positioned pipes.

It can thus be seen that the present invention has improved the state of the art, and thus those features of novelty descriptive of the spirit and nature of the invention are defined with particularity in the following claims.

I claim:

1. In a substantially horizontally oriented or disposed water pipe, a water pipe anti-rupture system for preventing freeze damage, comprising in combination, an assembly of a string of spaced hollow cups, each cup having a closed top portion and open bottom portion to provide a hollow chamber enclosed by continuous intermediate sidewall portions extending from the top portion to the bottom portion, said cups being aligned and fastened together with a connecting rod fastened from cup to cup so that said open bottom portion of each cup is oriented in a single direction, and periodically spaced resilient stabilizing leg members extending outwardly from the rod beyond the cups in a plane substantially perpendicular thereto, said leg members having a length greater than the diameter of said water pipe to frictionally grasp the interior surface of said water pipe and hold the spaced cups in residence along the pipe with the open hollow portions of each cup extending downwardly along the length of the pipe towards the interior bottom of the pipe and constituting a means to prevent pipe rupture of water in the pipe by entrapping sufficient air in the hollow chamber to absorb the expansion of freezing water.

2. A water pipe system as defined in claim 1 wherein the assembly is made of a plastic material of the class including PVC.

3. A water pipe system as defined in claim 1 wherein the assembly is in residence in substantially the center of a water pipe with legs frictionally engaged and the cup hollows directed downwardly.

4. A water pipe system as defined in claim 1 wherein the assembly comprises injection molded plastic material.

* * * * *